United States Patent [19]

Reifenhäuser

[11] 4,381,687

[45] May 3, 1983

[54] CUTTING DEVICE FOR CUBING MEAT PRODUCTS

[76] Inventor: Toni Reifenhäuser, Ritterstrasse 34, 5231 Burglahr, Fed. Rep. of Germany

[21] Appl. No.: 265,686

[22] Filed: May 20, 1981

[30] Foreign Application Priority Data

May 31, 1980 [DE] Fed. Rep. of Germany ..... 3020752

[51] Int. Cl.[3] ..... B26D 3/18

[52] U.S. Cl. ..... 83/404.3; 83/404.4; 83/408; 83/437

[58] Field of Search ..... 83/404.3, 404.4, 408, 83/437, 425.2, 425.3

[56] References Cited

U.S. PATENT DOCUMENTS 4,051,757 10/1977 Reifenhauser et al. ..... 83/404.3

4,280,385 7/1981 Kienzl ..... 83/404.3

*Primary Examiner*—Donald R. Schran

*Attorney, Agent, or Firm*—Arthur B. Colvin

[57] ABSTRACT

A device for cutting meat products into cubes in which the products are charged into a hopper having a portion thereof adjacent the floor conformed into a magazine into which a rough-pressing die is movable, a knife structure movable into the magazine cutting off sections of the product and a press-out die movable through the knife structure and magazine forcing such sections of the product through a series of knives at the outlet of the magazine to form strips which are subsequently severed into cubes.

4 Claims, 9 Drawing Figures

Fig. 5
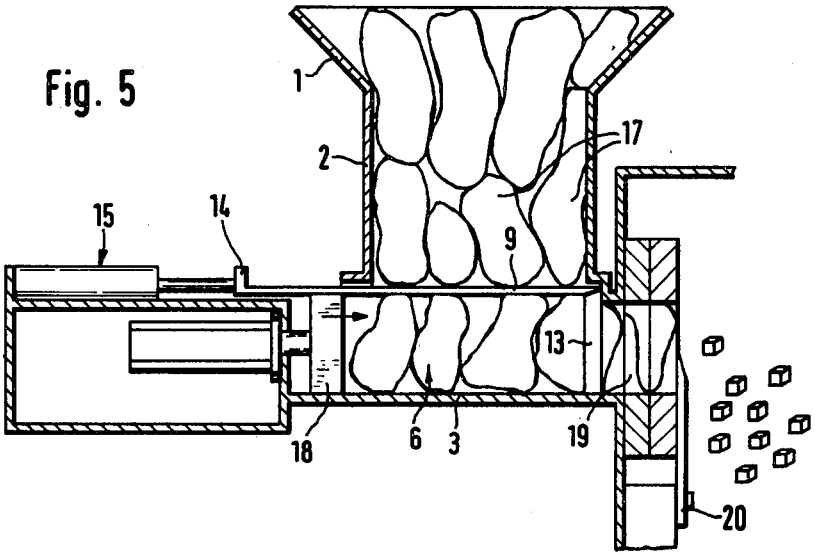
Fig. 6
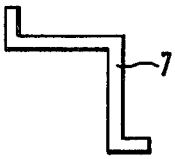
Fig. 7
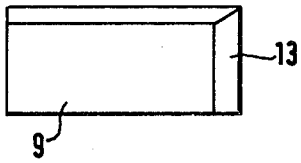
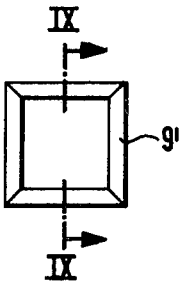
Fig. 8
Fig. 9
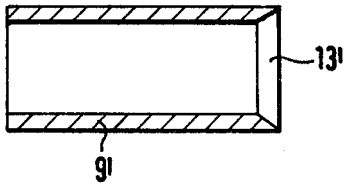

CUTTING DEVICE FOR CUBING MEAT PRODUCTS

The invention concerns a device for cutting meat, such as bacon or the like into cubes, comprising an oblong, box-shaped magazine for receiving the material, which is associated with a rough-pressing die extending over the length of the magazine and displaceable at right angles to the longitudinal axis of the magazine, while the material is pressed with a press-out die adapted to the cross section of the magazine and displaceable in the longitudinal direction of the magazine against frame knives arranged at an open end of the magazine.

In a known device of this type a length wall of the magazine extending at right angles to the filling hole is designed as a rough-pressing die which can be moved between a position defining the cross section of the feeding die, and a position transverse to the longitudinal axis of the magazine defining a larger magazine cross section. In the position of the magazine length wall designed as a rough-pressing die defining a larger magazine cross section, the magazine has a larger filling cross section, so that accumulations of the material to be cut in the filling range of the magazine can be better avoided than in a magazine with a filling cross section that cannot be widened.

A disadvantage of the known device, however, is that the rough-pressing die, which can be displaced transverse to the longitudinal axis of the magazine, must be moved in any case into the position limiting the feeding die, regardless of the state of compression of the material to be cut, so that a magazine cross section is formed which corresponds to the feeding die. Due to the displacement of the rough-pressing die transverse to the longitudinal axis of the magazine, the compression may vary quite considerably depending on the consistency of the material to be cut, which results in cubes of varying size. It is possible also that, due to premature excessive compression, the rough-pressing die can not even be moved into a corresponding position defining the cross section of the feeding die, so that the rough-pressing die must be returned to remove excess material from the magazine.

In another known device of this type, the material to be cut drops from a collecting hopper into an antechamber arranged next to a cutting filling box which has the same opening as the collecting hopper discharge, but the opening is much wider than the magazine proper. By means of a slide designed as a rough-pressing die, the material to be cut is pushed out of the ante-chamber into the magazine, but the slider is not advanced up to the filling end transverse to the longitudinal axis of the magazine, but leaves a part of the filling opening open, so that excess material can yield out of the opening upward into the collecting hopper after the magazine is full. In this known device, the magazine is arranged laterally of the hopper and requires an additional engineering effort. A particular disadvantage is that after the magazine is full, excess material is pushed upward into the collecting hopper over the remaining opening, and crushing and disintegration of the relative sensitive material is unavoidable.

In order to insure a quantitatively constant charge of the magazine in a dicing machine for foods, like meat, bacon, etc. in a simple manner, and to prevent accumulation of the material to be transported without additional means, it has already been suggested in a magazine with a rectangular cross section, in which a movable die presses the material against frame knives arranged at an open end of the magazine, to arrange a cross sectional diagonal of the magazine horizontally, so that its length determines the width of the filling hole, where the magazine can be closed by a roof angle-shaped slide moving parallel to the die and equipped with two sharp front edges.

In this known dicing magazine, the free opening cross section is greatly increased by the diagonal arrangement of the magazine, so that the risk of accumulation at this filling hole, which is always considered a bottleneck in the delivery path, is greatly reduced. The magazine receives this way for each working cycle the same amount of material without the excess material having to be displaced. Only after the magazine is closed by the roof angle-shaped slide equipped with cutting edges, which separates the amount of material in the magazine from the material remaining in the hopper without crushing it, is the material to be cut compressed uniformly by the feed of the press-out die.

In practice it has been found that accumulations still occur in this machine, in the case of large pieces. The reason for these occasional accumulations in the conveyance of material is that the roof angle-shaped slide enhances the formation of a bridge with the material remaining in the hopper, if this material consists of correspondingly large pieces. These support each other more intensively, the greater the pressure that is exerted on the material from the top.

The object of this invention is to improve a device of the above described type so that a quantitively constant charge of the material is insured, even with large pieces of the material to be cut, without the use of elaborate additional means to avoid accumulations in the conveyance of the material.

Based on the above-described device, it is suggested, according to the invention, to devine the cavity of a magazine on the bottom, by a part of a bottom surface of a hopper; on the side opposite a rough-pressing die, by a part of a side wall surface of the hopper, and on the side facing the rough-pressing die as well as on the top side by lateral surfaces of the arms of an angular knife moving parallel to a press-out die, into the magazine closing position.

Due to the design according to the invention, a magazine is located in the hopper, which is independent in its size from the hopper volume. The rough-pressing die, in the device according to the invention only has the function of pre-compressing the material to be cut, which can be controlled exactly with known means independent of the pressure. As soon as the desired rough-pressing has been achieved, the angular knife can be brought into closing position, so that the closure for the magazine is formed. In the magazine thus formed the material to be cut is therefore always compressed in an amount corresponding to the volume thereof.

One embodiment of the invention provides that the angular knife is guided with bent-off lateral edge strips of its arms in grooves which are formed each by a slot in the bottom surface and in the side wall surface of the hopper. Due to this design, according to the invention, the angular knife is not only guided safely, but it is given an improved bending stiffness by the bent-off lateral edge strips, so that the wall thickness of the knife can be selected relatively thin, particularly since the knife acts only after the lateral precompression of the material by the rough-pressing die and therefore does not have to absorb any large forces perpendicularly to the plane of the knife.

Another embodiment of the invention provides that walls of the slots form guide surfaces for the bent-off lateral edge strips of the arms of the knife by lateral strips in the bottom and side wall of the hopper, which are offset by the thickness of the arms of the angular knife.

This design, according to the invention, insures not only a safer guidance of the angular knife, but also facilitates the sealing between the knife guide and the lateral edge strips of the knife arms.

Finally another embodiment of the invention provides that the angular knife is supplemented by two additional arms to provide a knife with a rectangular cutting edge, which is closed upon itself.

This design, according to the invention, makes slots in the bottom surface and in the side wall of the hopper for guiding the knife unnecessary, and permits an extremely low wall thickness of the knife, since the box shape of the knife leads to optimum bending stiffness. Furthermore, this design of the knife has the advantage that sealing problems in the magazine range of the hopper cannot appear at all.

An embodiment of the device according to the invention is represented schematically in the drawing.

FIG. 5 shows a cross section according to FIG. 4, but with the knife in the closing position of the magazine.

FIG. 6 shows the angular knife in an elevation.

FIG. 7 shows the knife according to FIG. 6 in a side elevation.

FIG. 8 shows a view of the knife with a rectangular cutting edge course.

FIG. 9 shows a cross section through the knife along line IX—IX of FIG. 8.

Figure 1:
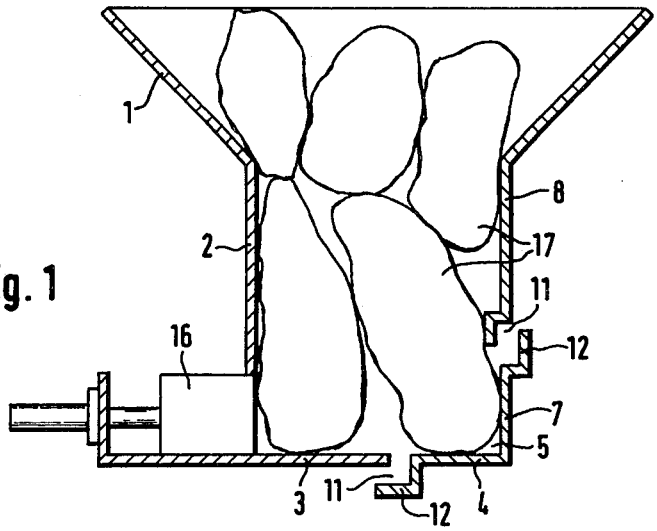
FIG. 1 shows a vertical cross section through the device with a rough-pressing die retracted into its starting position.

Referring now to the drawings, the device consists substantially of a funnel-shaped part 1, rising from a hopper 2. Hopper 2 has a bottom surface 3, a part 4 of which forms the right-hand corner on the bottom in FIGS. 1 and 2 defines a cavity 5 of a magazine 6, the cavity 5 being defined on one side by a part 7 of a side wall surface 8 of hopper 2. As it can be seen, particularly from FIG. 3, cavity 5 of magazine 6 is defined on the sides opposite parts 4 and 7 by an angular knife 9.

Bent-off lateral edge strips 10 of knife 9 are guided in grooves 11 which are formed by offset lateral strips 12 of parts 4 and 7.

Figure 4:
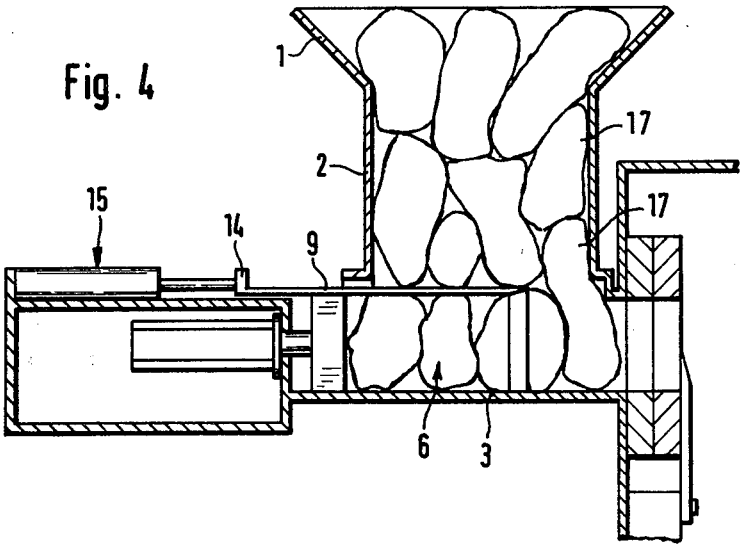
FIG. 4 shows a cross section along line IV—IV of FIG. 3, where the angular knife has covered a part of the feed path.

As can be seen from FIGS. 4 and 5, a cylinder-piston rod unit 15 acts on end 14 of knife 9 opposite cutting edge 13 thereof so that the knife can be displaced in the longitudinal direction of magazine 6.

A rough-pressing die 16 moving at right angles to the longitudinal direction of magazine 6 and extending over the length of magazine 6 is displaced over bottom surface 3 and is in the retracted position outside the base of hopper 2 as shown in FIG. 1 so that pieces 17 to be cut can drop unhindered into funnel 1 through hopper 2 onto bottom surface 3.

Figure 2:
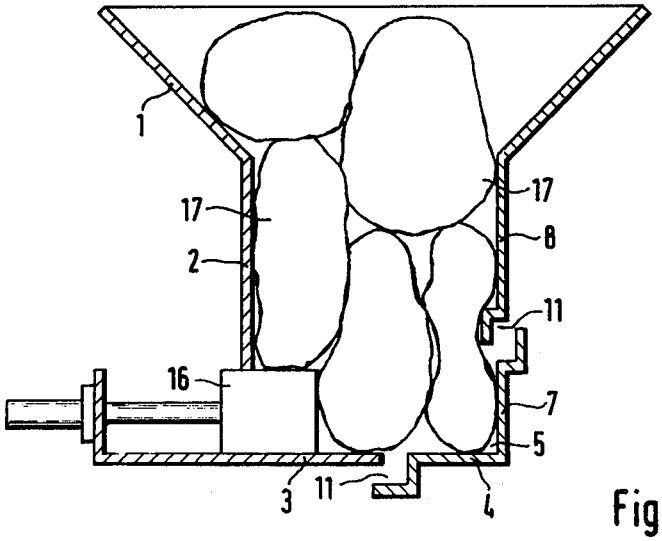
FIG. 2 shows a vertical cross section through the device according to FIG. 1, but with the rough-pressing die advanced into rough-pressing position.
Figure 3:
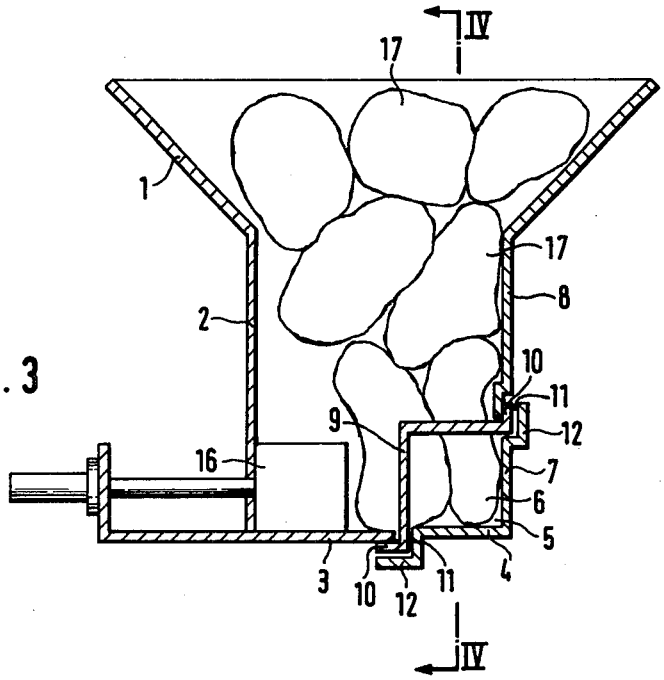
FIG. 3 shows a vertical cross section through the device according to FIG. 2 with the angular knife advanced into the closing position of the magazine.

When rough-pressing die 16 advances from the retracted position shown in FIG. 1 into the position shown in FIG. 2, pieces 17 are precompressed, and this compression can be adjusted to any desired amount in such a way that the rough-pressing die 16 does not have to cover a fixed path in the pressing direction. When the desired precompression of pieces 17 has been achieved, angular knife 9 can be brought into the closing position of magazine 6 represented in FIG. 5, independent of the position of rough-pressing die 16. At the same time or immediately thereafter, a press-out die 18, adapted to the cross section of cavity 5 of magazine 6, can press pieces 17 through an opening 19 crossed by frame knives (not shown), which cut pieces 17 into strips which are then subdivided into cubes by knives 20 moving up and down in the present plane of the opening.

While FIGS. 6 and 7 show the angular knife, FIGS. 8 and 9 show a knife 9' supplemented by two additional knife arms, which thus has a cutting edge 13' with a rectangular course that is closed upon itself.

Having thus described my invention, what I claim as new and desire to secure by Letters Patent of the United States is:

1. A device for cutting meat products into cubes, comprising an oblong, box-shaped magazine for receiving the material, a hopper to supply said magazine, a rough-pressing die associated with the magazine and extending over the length of the magazine and displaceable at right angles to the longitudinal axis of the magazine, frame knives arranged at an open end of the magazine, a press-out die conformed to the cross section of the magazine and displaceable against the meat product in the longitudinal direction of the magazine against said frame knives, an angular knife which is movable parallel to the press-out die into the magazine closing position, said knife having at least two arms, said magazine having a cavity defined on the bottom by a part of the bottom surface of said hopper, on the side opposite the rough-pressing die by a part of a side wall surface of said hopper and on the side facing the rough-pressing die as well as on the top side by lateral surfaces of the arms of said knife.

2. A device according to claim 1 in which the arms of said angular knife have bent-off lateral edge strips and a slot is formed in the bottom surface and the side wall surface of the hopper to define grooves to guide said edge strips.

3. A device according to claim 2 in which the walls of the slots forming the guides for the bent-off lateral edge strips of the arms of the knife have edge strips which are offset by the thickness of the arms of the angular knife in the bottom and side wall surface of the hopper.

4. A device according to claim 1 in which the angular knife is supplemented by two additional arms to define a rectangular cutting edge which is closed upon itself.

* * * * *